US005515672A

United States Patent [19]

Koltze et al.

[11] Patent Number: 5,515,672

[45] Date of Patent: May 14, 1996

[54] TRANSPORT SYSTEM IN A POT SPINNING MACHINE

[75] Inventors: Karl Koltze, Mönchengladbach; Robert Hartel, Aachen; Joachim Stiller, Mönchengladbach; Karl-Josef Brockmanns, Willich, all of Germany

[73] Assignee: W. Schlafhorst AG & Co., Moenchengladbach, Germany

[21] Appl. No.: 271,104

[22] Filed: Jul. 6, 1994

[30] Foreign Application Priority Data

Jul. 17, 1993 [DE] Germany ..... 4324039.9

[51] Int. Cl.[6] ..... D01H 1/08; D01H 9/00

[52] U.S. Cl. ..... 57/281; 57/76; 57/312

[58] Field of Search ..... 57/281, 76, 77, 57/312

[56] References Cited

U.S. PATENT DOCUMENTS

| | | | |
|---|---|---|---|
| 802,161 | 10/1905 | Gill | 57/312 |
| 2,142,760 | 1/1939 | Prince-Smith | 57/312 |
| 2,291,819 | 8/1942 | McCann | 57/312 X |
| 3,030,761 | 4/1962 | Negishi | 57/312 X |
| 3,098,343 | 7/1963 | Negishi | 57/312 |
| 3,205,645 | 9/1965 | Kato | 57/76 |
| 4,660,370 | 4/1987 | Matsui et al. | 57/281 |
| 4,964,269 | 10/1990 | Kinkelmann | 57/281 |
| 5,167,115 | 12/1992 | Wernli et al. | 57/281 |
| 5,289,675 | 3/1994 | Brockmanns et al. | 57/312 |
| 5,385,007 | 1/1995 | Hartel et al. | 57/312 X |

FOREIGN PATENT DOCUMENTS

| | | |
|---|---|---|
| 0331638 | 4/1989 | European Pat. Off. . |
| 0504615A1 | 9/1992 | European Pat. Off. . |
| 1144629 | 2/1963 | Germany . |
| 4008990A1 | 12/1990 | Germany . |
| 4108929A1 | 9/1992 | Germany . |

OTHER PUBLICATIONS

"Produktivitätssteigerung mit Co–We–Mat", Zinser Textilmaschinen GmbH, 6 pages Dec. 1975.

*Primary Examiner*—Joseph J. Hail,III

*Attorney, Agent, or Firm*—Shefte, Pinckney & Sawyer

[57] ABSTRACT

Because of the pot spinning process, it is more difficult to automate the supply of empty tubes, respooling of the spinning cake on an empty tube, and the removal of the spinning cops in a pot spinning machine than with other spinning processors. The present invention provides a completely automatic exchange of spinning cops for empty tubes at the spinning stations of a pot spinning machine by utilizing the yarn guides of pot spinning stations to place full yarn cops produced thereat into an upright position on carriers located on a movable conveyor extending underneath the spinning pots. With the spinning cops deposited onto the conveyor and with the yarn guide returned to a spinning position, the conveyor can transport the carriers with the spinning cops away and can deliver empty tubes to the spinning stations for receipt by the yarn guides to continue the spinning process.

6 Claims, 3 Drawing Sheets

TRANSPORT SYSTEM IN A POT SPINNING MACHINE

FIELD OF THE INVENTION

The present invention relates to a transport system in a pot spinning machine having stationarily disposed spinning pots and traversing yarn guides, wherein empty tubes intended for the respooling of the spinning cake are pushed over and held by the yarn guides in the course of the spinning operation.

BACKGROUND OF THE INVENTION

While operations of ring spinning machines and open end spinning machines are largely automated, in particular the exchange of a bobbin wound with a spun yarn by an empty tube, such automation is unknown in connection with pot spinning machines. A pot spinning machine is disclosed in German published, non-examined patent application DE-OS 41 08 929, wherein an automatic spinning bobbin exchange is described. However, a transport system for the automatic delivery of empty tubes to the spinning stations and transport of the full yarn packages away from the spinning stations is limited to the exemplary embodiment shown.

It is known from U.S. Pat. No. 802,161 to place an empty yarn tube onto the yarn guide of a pot spinning machine during placement of the yarn in the spinning pot for subsequent respooling of the cake of yarn from the pot onto the empty tube to produce a yarn cop when the formation of the yarn cake is completed. However, with this known pot spinning machine, it is still required to remove each individual spinning cop manually from the yarn guide and to replace it by an empty tube.

SUMMARY OF THE INVENTION

It is therefore an object of the present invention to provide a tube transport system which can be adapted to individual pot spinning machines.

The present invention makes possible the automatic removal and transportation of the spinning cop away from a pot spinning station after the spinning cake has been respooled on the empty tube, and simultaneously the delivery of an empty replacement tube for automatic pick-up at the spinning station. Thus, with the present invention, manual intervention for exchanging spinning cops for empty tubes is no longer required. Following respooling of the respective spinning cakes on the empty tubes, the spinning cops can be placed with the aid of the yarn guides in a vertical disposition on a movable conveyor system underneath the spinning pots. With the spinning cops set down and the yarn guides in the raised position, the conveyor system can transport the spinning cops away and deliver the empty tubes into position for insertion of the yarn guides and for being taken up by the carriers.

The transport system can be embodied in a conveyor belt equipped with fixed arbors extending successively underneath the spinning stations along the spinning machine. The empty tubes can be transported on the conveyor belt to the spinning stations and the spinning cops away from the spinning stations on the arbors. With such an embodiment of the invention, the spinning cop exchange process is performed in essentially the same way as doffing on a ring spinning machine. The conveyor belt with the arbors can be respectively displaced from a position where it takes on a spinning cop into a position where it delivers and releases an empty tube. In correspondence to the known doffing operations in ring spinning machines, the spinning cop exchange is simultaneously performed with the conveyor belt at all spinning stations of the pot spinning machine. The conveyor belt is set up with alternate arbors left empty for receiving the spinning cops located underneath the spinning pots and intervening arbors provided with an empty tube. After placement of the full yarn cops on the empty arbors, the belt advances by a distance equal to one-half the spacing between the spinning stations. In the process, the full yarn cops are moved from beneath the spinning pots and the empty tubes are transported underneath the yarn guides to be available for the tube exchange. The belt is then stopped and the yarn guides are lowered and inserted into the empty tubes, in the course of which the empty tubes are telescoped over the yarn guides. Each empty tube is fastened to the yarn guide by appropriate means, for example, a clamping device on the yarn guide. The yarn guide subsequently moves back into the spinning pot and is placed into the spinning position for forming a new spinning cake.

Following the doffing operation, the conveyor belt with the spinning cops travels from the pot spinning machine to a transfer station, for example, where the spinning cops may be transferred to another transport device for transporting them to a yarn winding machine. Such a combination of a spinning machine with a winder is known from German published, non-examined patent application DE-OS 40 08 990, however, in this case the spinning machine is a ring spinning machine.

In another embodiment of the present invention, a conveyor belt extends underneath the spinning stations along the spinning machine and supports independent carriers equipped with arbors for transportation of yarn cops and empty tubes. Carriers with empty arbors for receiving spinning cops and carriers with empty tubes on their arbors for exchange at the spinning stations are provided on the conveyor belt. This design of the transport system allows the individual independent control and operation of each separate spinning station. After completion of the winding of a spinning cop, each separate spinning station can signal for a carrier with an empty arbor in order to receive and remove the spinning cop and, after the spinning cop has been taken away, can signal for a carrier with an empty tube on its arbor for receipt on the now vacant yarn guide. For performing such an exchange, sensors must be provided which can differentiate between carriers with empty arbors, carriers with empty tubes on their arbors, and carriers with full spinning cops on their arbors. The exchange can be accomplished with a continuously running conveyor belt transporting carriers in all three states along the spinning stations. When required, a particular carrier whose loaded or unloaded condition is suited to the momentary requirements of a spinning station may be halted by a stop device provided at the spinning station. However, the stoppage of a carrier also results in the stopping of all successive carriers during the placement of a spinning cop onto a carrier and the removal of an empty tube from a carrier. A distribution station would be provided at the end of the spinning machine, as viewed in the direction of transport of the conveyor belt to return the carriers with empty tubes and the carriers with unoccupied arbors via the belt to the spinning machine and to remove the carriers with full yarn cops from the transport system.

In a further embodiment of the invention, a conveyor belt is disposed along the spinning machine at a front side of the spinning stations for transporting carriers with arbors occupied by empty tubes on this conveyor belt. As required, these carriers with empty tubes can be brought to the spinning stations for respooling the spinning cake onto the empty tubes, and the carriers remain in their position at the spinning station during spinning and respooling. This type of transport system has the advantage that the transport of the remaining carriers is not hampered during the placement of the yarn cops onto the carriers and removal of the empty tubes from the carriers. Carriers with empty tubes are diverted from the conveyor belt, for example, by switches at the spinning stations and are guided to the respective spinning station by means of another transport device, for example, another conveyor belt. This conveyor belt may be a reversibly driven belt so that, after placement of the spinning cop on a carrier, the carrier is again returned via the reversing belt to the supply conveyor belt. In this case, a device must be provided at the end of the supply conveyor belt to remove the spinning cops from the conveyor belt. Carriers with empty tubes on their arbors must be made available at the start of the conveyor belt along the spinning machine in correspondence to the removal of the finished spinning cops.

Also conceivable is a complete connection between the spinning machine and a yarn winding frame, wherein the full yarn cops are transported on their carriers through the winding stations of the winding frame where they are unwound while remaining on the carriers and the emptied tubes returned on their carriers to the feed conveyor belt for the spinning machine to be shunted off the feed conveyor belt to the individual spinning stations for respooling of another spinning cake onto the empty tube.

Such a circuit constitutes a completely closed cycle which allows the fully automatic supply, without human intervention, of the spinning machine with empty tubes and of the winding frame with the spinning cops of the spinning machine. This transport system does not require the transfer from one transport system of the spinning machine to another transport system of the winding frame and only as many carriers as are actually needed at the spinning stations and the spooling stations are circulating in the transport system.

BRIEF DESCRIPTION OF THE DRAWINGS

FIGS. 1*a* to 1*h* are schematic side elevations which show a spinning station of a pot spinning machine of the present invention in successive stages of operation, wherein the delivery of empty tubes and the removal of spinning cops takes place by means of a selectively stoppable conveyor belt equipped with fixed arbors, similar to a doffing operation in ring spinning machines, or alternatively by means of a continuously moving conveyor belt on which carriers with arbors are transported and, when required, can be stopped in place on the continuously moving belt;

DESCRIPTION OF THE PREFERRED EMBODIMENTS

Figure 2:
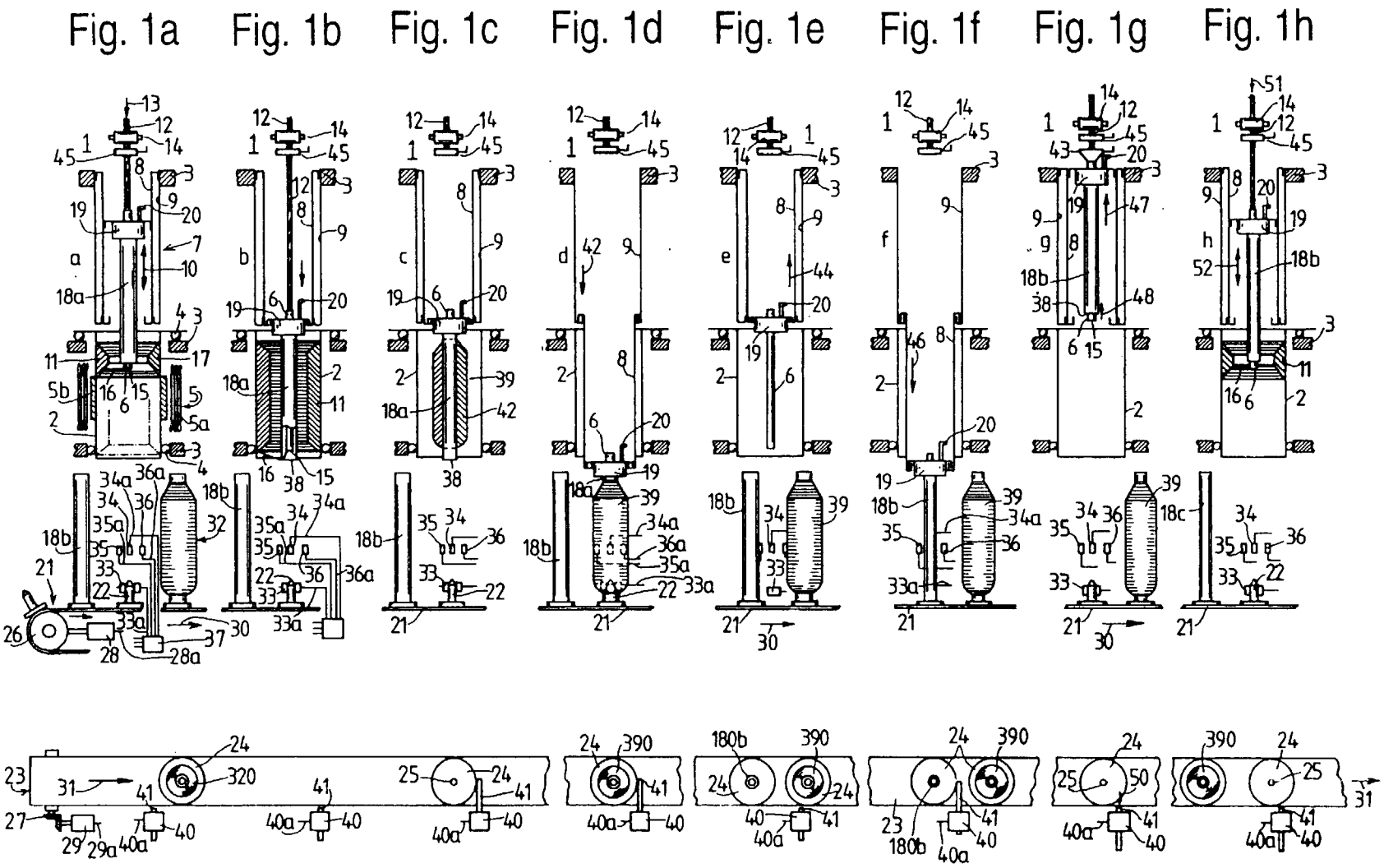
FIG. 2 is a top plan view of an alternative embodiment of continuous conveyor means for use in the pot spinning machine of FIGS. 1*a*–1*h*.

The operational course of a spinning cop exchange at a spinning station of a pot spinning machine is described in relation to several successive operational steps in FIGS. 1*a*–1*h*. The design of the spinning station 1 of the pot spinning machine is illustrated schematically, showing only the most important features for its function as well as features contributing to the invention. As will be understood, the pot spinning machine is equipped with a plurality of such spinning stations.

A spinning pot 2 is seated in a machine frame which is only partially and schematically indicated at 3. The pot 2 is supported for rotation by a ball bearing seat 4 and is driven by a drive, indicated representatively at 5, in a manner which is known, for example, in German published, non-examined patent application DE-OS 41 08 929. The spinning pot 2 is in the shape of a cylindrical tube which is open at its top and bottom ends. In the present exemplary embodiment, the spinning pot 2 is embodied as the rotor of a squirrel-cage motor. In this case, it is possible that the spinning pot itself may be made from a non-metallic material, around which a thin metal ring 5*b* forming a short-circuited rotor is placed in the area of the stator 5*a*. The bearings 4 of the spinning pot are only schematically shown and are not intended as a restriction to any specific embodiment of a bearing. For example, the spinning pot can also be seated in magnetic bearings or air bearings.

In the present embodiment, the spinning pot 2 is seated to rotate in a stationary disposition in the machine frame 3. In contrast thereto, a yarn guide 6 extending into the spinning pot moves vertically back and forth therein for building the spinning cake.

A suspension 7 and a drive (not shown) for the yarn guide 6 are disposed above the spinning pot 2. The drive mechanism can be, for example, in the form of hydraulic or pneumatic cylinders or a toothed rack and pinion gear arrangement. The yarn guide 6 glides up and down like a piston in a guide tube 8 and this guide tube 8 is displaceably disposed in a guide 9 which is fixedly connected with the machine frame 3, i.e., the yarn guide 6 can move up and down inside the guide tube 8, as represented by the double-headed arrow 10, while the guide tube 8 can move independently of this motion inside the guide 9. The drive mechanism of the guide tube 8 is not shown. As with the yarn guide 6, for example, it can also be in the form of hydraulic or pneumatic cylinders. The stroke of the yarn guide 6 is determined by the length of the spinning pot 2, while the path of the guide tube 8 is limited by the length of the guide 9. When the yarn guide 6 assumes the lowest position in the guide tube 8 and the guide tube 8 is completely extended out of the guide 9 (see, e.g., FIGS. 1*d* and 1*f*), a spinning cop can be set down or an empty tube can be taken up, as will be explained in detail hereinafter.

FIG. 1*a* illustrates a spinning station while a spinning cake 11 is being created. A sliver 12 is supplied downwardly in the direction of the arrow 13 to the yarn guide 6 from a drafting device (not shown) via a pair of feed rollers 14. The yarn 16 being formed exits from the mouth 15 of the yarn guide 6 and, in the present exemplary embodiment, is placed in layers 17 within the spinning pot 2 to progressively form a cake-like structure or body of the yarn that can be subsequently respooled on an empty tube into the form of a spinning cop like that produced by a ring spinning machine, providing particularly good reel-off properties when respooled on a cheese.

During the spinning process, the yarn guide 6 supports an empty tube 18*a* which is placed telescopically over the guide 6 and is supported by a holder 19 at the upper end of the yarn guide 6. The holder 19 is simultaneously used to traverse the yarn guide 6 inside the guide tube 8. The manner in which the empty tube 18*a* is held is not an object of the invention and is already known from the prior art, for example, from U.S. Pat. No. 802,161. The holder 19 also offers the possibility of displacing the yarn guide 6 with respect to the empty tube 18*a*. Actuation of the holder 19 of the empty tube 18*a* as well as the regulation of relative movement between the empty tubes 18 and their yarn guides 6 takes place via control line 20.

The transport system of the present invention is herein explained with respect to two exemplary embodiments in FIGS. 1*a* to 1*h*. Either a conveyor belt 21 equipped with fixed tube support arbors 22 or a conveyor belt 23, on which independent tube carriers 24 having respective arbors 25 can be transported, extend underneath the spinning stations of the pot spinning machine. The two conveyor belts 21 and 23 are endless belts which travel underneath all of the spinning stations of the spinning machine. The conveyor belts are respectively guided over supporting guide rollers 26 or 27 which at the same time can be used for driving the belts, as indicated, for example, by the motors 28 or 29. The arrows 30 and 31 indicate the direction of movement of the conveyor belts 21 and 23. While the conveyor belt 23 runs continuously, the conveyor belt 21 is only moved when it is intended to make an exchange of finished spinning cops for empty tubes at the spinning stations and when the spinning cops are to be transported away and fresh empty tubes are to be provided.

The conveyor belt 21 is stopped during the spinning operation with an unoccupied arbor 22 positioned in centered relation to the yarn guide 6, underneath the spinning pot 2 under each spinning station 1. In such disposition, the unoccupied arbors 22 are positioned to receive spinning cops form the respective spinning stations thereabove as described below. Viewed in the direction of transport 30, an empty tube 18*b* is disposed behind the unoccupied arbor in a stand-by position on the next succeeding arbor 22. The sequence of arbors occupied by empty tubes and empty arbors corresponds to the arrangement known in connection with ring spinning machines. The spacing of the arbors along the conveyor belt 21 is one-half that of the distance between the center axes of two adjacent spinning pots. After the spinning cops are deposited from the spinning pots onto the unoccupied arbors, the belt 21 advances by such spacing, i.e., half the distance between two adjacent spinning pots, in order to position the empty stand-by tubes 18*b* to be received in the spinning pots.

As will be understood, a conveyor belt 21 with arbors 22 fixedly disposed on the conveyor belt only permits simultaneous doffing at all spinning stations. The spinning cop 32 in FIG. 1*a* is intended to symbolize the removal of the spinning cops after a doffing operation. For this reason the belt 21 in FIG. 1*a* is interrupted in contrast to the portion of the belt 21 with the stand-by arbor 22 and the stand-by empty tube 18*b*.

Positioning of the arbors 22 for receiving spinning cops and for transferring empty tubes can be monitored by means of sensors. Correct positioning of an arbor 22 underneath the spinning pot of a spinning station can be checked by means of a sensor 33. By means of a further sensor 34 it can be determined whether an empty tube, for example the empty tube 18*a*, is located on an arbor 22. This sensor 34 is disposed directly above the sensor 33 a sufficient distance so that it does not detect the arbors. Further sensors 35,36 can be disposed beside the sensor 34. One sensor 35,36 would be sufficient as a rule. By means of these sensors, it can be determined whether a yarn-wound tube, i.e., a finished spinning cop wound with yarn, is present underneath the spinning station. It is possible to determine the state or degree of winding, i.e., the amount of yarn, of a spinning cop currently positioned in front of the sensors by positioning the sensors 35,36 at different distances from the sensor 34 in respect to the center line of the empty tube. As can be seen in FIG. 1*a*, the positioning of an arbor 22 is reported by the sensor 33 via a signal line 33*a* of a control device 37, for example, a microprocessor. In the present situation, the sensors 34,35,36 do not detect the presence of any tube or spinning cop on the arbor 22 and report such via their signal lines 34*a* to 36*a* to the control device 37. The control device 37 can also be connected with a main computer (not shown) of the spinning machine or with a central computer for several spinning machines in order to control the operations of the spinning machine.

FIG. 1*b* shows the end of spinning and the start of respooling of the spinning cake 11 from the inner wall of the spinning pot 2 onto the empty tube 18*a* carried on the yarn guide 6. So that the respooling process can be initiated, the empty tube 18*a*, which as aforementioned had been placed onto the yarn guide 6 by the holder 19 when the yarn guide 6 was in its lowest position, is pushed sufficiently far over the mouth 15 of the yarn guide 6 that the lower rim 38 of the tube 18*a* reaches the extent of the yarn 16 exiting from the mouth 15 of the yarn guide 6 and extending to the inner wall of the spinning pot 2. The yarn can be grasped by and engaged in a notch (not shown) in the rim 38 of the tube 18*a*. At the same time, feeding of the sliver 12 into the yarn guide 6 is stopped and the sliver 12 is clamped and cut below the drafting device by a clamping and cutting device 45. The excess sliver is aspirated off by a suction means (not shown). The yarn is then immediately wound on the empty tube 18*a* by respooling the spinning cake 11 from the spinning pot 2 onto the empty tube 18*a*, the completion of which is illustrated in FIG. 1*c* wherein the spinning cake is shown to have been completely respooled on the empty tube 18*a* and a spinning cop 39 thereby created.

In the alternative embodiment of a conveyor belt 23, the conveyor belt 23 has transported carriers up to this time without regard to the operation of the spinning station 1. In contrast to the exemplary embodiment with a continuous conveyor belt on which the arbors are fixed and the exchange process of spinning cops for empty tubes is performed simultaneously at all spinning stations, the individual control of spinning stations is possible in the exemplary embodiment having a conveyor belt 23. Each spinning station 1 can be individually actuated and forms spinning cops independently of the adjoining spinning stations, which cops are directly placed onto carriers 24 on the conveyor belt 23 as soon as they are finished. Because the belt 23 runs continuously, stopping devices 40 for the carriers are installed at every spinning station and are controlled by means of the sensors 33 to 36, as shown in FIG. 2. For this purpose each stopping device 40 is connected via a signal line 40*a* with the control device 37. It is therefore possible in the exemplary embodiment with a conveyor belt 23 underneath the spinning station that carriers 24 which are occupied or empty can be moved without hindrance, while spinning is performed at the spinning stations as shown in FIG. 1*a*. For example, a spinning cop 320 is representatively shown as being moved unhampered past the spinning station which at that moment is spinning a yarn.

Transporting of cops and tubes on the belt 23 is only interfered with at the time when the spinning cake has been respooled from the spinning pot on an empty tube at a spinning station and a finished spinning cop is ready to be exchanged for an empty tube, as is the case in FIG. 1*c*. The stopping device 40 underneath the spinning station ready for the exchange is then triggered by the control device 37 of the pot spinning machine and a restraining lever 41 is extending across the belt 23. However, the stopping device 40 is only actuated when the sensors 33,34 identify a carrier 24 on the belt 23 with an unoccupied arbor 25.

The deposit of the finished spinning cop 39 onto the arbor 22 of the conveyor belt 21 is shown in FIG. 1*d*. To deposit the spinning cop 39, the guide tube 8 is lowered in the guide 9 by suitable means (not shown) as symbolized by the arrow 42. Once the guide tube 8 has reached its lowest position in the guide 9, the tube 18*a* has been seated on the arbor 22 disposed therebelow. The holder 19 is actuated via the control line 20 to release the tube 18*a* of the spinning cop 39.

In the embodiment of a conveyor belt 23, the deposit of a spinning cop 39 onto an arbor 25 of a carrier 24 stopped by a restraining lever 41 takes place in the same way.

In each embodiment, after release of the tube 18*a* with the cop 39 by the holder 19, the guide tube 8 is moved back into its uppermost position within the guide 9, as indicated by the arrow 44 in FIG. 1*e*. In the process, the yarn guide 6 is pulled out of the deposited tube 18*a*. When the guide tube 8 has been moved into its uppermost position, the yarn guide 6 is in a raised position which permits the transport of the full spinning cop 39 on the conveyor belt 21 or 23. In the case of the embodiment having the conveyor belt 21, the drive motor 28 of the conveyor belt 21 receives a signal via the control line 28*a* to drive the deflection roller 26 to move the conveyor belt 21 in the direction of the arrow 30 until the sensors 33,34 register a following empty tube 18*b* on the belt 21 which, in the illustrated embodiment, is a distance equal to one-half of the spacing between adjacent spinning stations which is sufficient that the empty tube 18*b* is positioned underneath the spinning pot 2 in alignment with the yarn guide 6.

In the case of the embodiment with a conveyor belt 23, the restraining lever 41 is retracted by a signal via the control line 40*a*, and the carrier 24 with the spinning cop, in this case cop 390, is released for transportation away from the spinning station. The restraining lever 41 is only actuated again when an empty tube following on the conveyor 23 is registered by the sensors 33,34. In the illustrated example in FIG. 2, this is an empty tube 180*b* on the carrier 24, which follows the released spinning cop 390.

Once an empty tube, such as tube 18*b* on the conveyor belt 21 (FIGS. 1*a*–1*h*) or tube 180*b* on carrier 24 on the conveyor belt 23 (FIG. 2) has been positioned underneath the yarn guide 6, the guide tube 8 is again moved into its lowest position as indicated by the arrow 46 in FIG. 1*f*. Once the guide tube 8 is in its lowest position, the yarn guide 6 extends telescopically into the empty tube 18*b* whereupon the holder 19 grasps the empty tube to retain it in place on the yarn guide 6. In the embodiment with a conveyor belt 23, the released spinning cop 390 is concurrently being transported away from the spinning station because the conveyor belt 23 continuously moves in the transport direction indicated by the arrow 31.

After the empty tube 18*b* has been grasped by the holder 19, the guide tube 8 and the yarn guide 6 move into the uppermost position above the spinning pot 2, as indicated by the arrow 47 in FIG. 1*g*. The grasped empty tube is raised by the holder 19, as indicated by the arrow 48, until the mouth 15 of the yarn guide 6 projects beyond the lower rim 38 of the tube 18*b*. The sliver is released from the clamping and cutting device 45 and is moved through the pair of feed rollers 14 into an injector 43, which operates to blow the sliver into the yarn guide 6. Thereafter, the yarn guide 6 moves into the spinning pot 2, and spinning is again initiated by the renewed supply of the sliver.

In the first embodiment, the conveyor belt 21 is simultaneously put into motion so that the finished spinning cops 39, which had been deposited onto the conveyor belt 21 by all the spinning stations, are transported away to a collection location.

In the embodiment having the conveyor belt 23, the restraining lever 41 is retracted as indicated by the arrow 50, so that the now empty carrier 24 from which the empty tube 180*b* had been removed can be transported away from the spinning station. As already described above, the carrier 24 with the finished spinning cop 390 has already been transported away.

Thus, as will be seen, the operation of the pot spinning machine has progressed in sequence to the stage shown in FIG. 1*h* which is the same as indicated in FIG. 1*a* at the beginning of the described sequence. The yarn guide 6 has been returned to the spinning position in the spinning pot 2. Simultaneously the drafting device has supplied the sliver 12 as indicated by the arrow 51. The arrow 52 indicates that the yarn guide 6 is again reciprocating upwardly and downwardly to build a fresh spinning cake 11 in the spinning pot 2 in a cross-winding fashion.

In the course of this operation, the finished spinning cops 39 have been transported away on the conveyor belt 21 and the conveyor belt 21 has again been equipped with fresh empty tubes 18*c* and, at the same time, the conveyor belt 21 has again been positioned and stopped such that the empty arbors 22 have been disposed directly underneath the spinning stations. In the embodiment utilizing a conveyor belt 23, the conveyor belt 23 continues to travel underneath each working spinning station whose associated restraining lever 41 has therefore been retracted. Thus, independently of the work of the spinning station located above it, the conveyor belt 23 transports carriers, which may be randomly equipped with empty tubes or spinning cops or may be empty as a result of the operation of the spinning stations located upstream in the direction of movement of the conveyor belt 23. Operation of the lever 41 intervenes in the normal ongoing transport of carriers on the conveyor 23 only for positioning of a carrier at a spinning station when a change at the appropriate spinning station is required.

Figure 3:
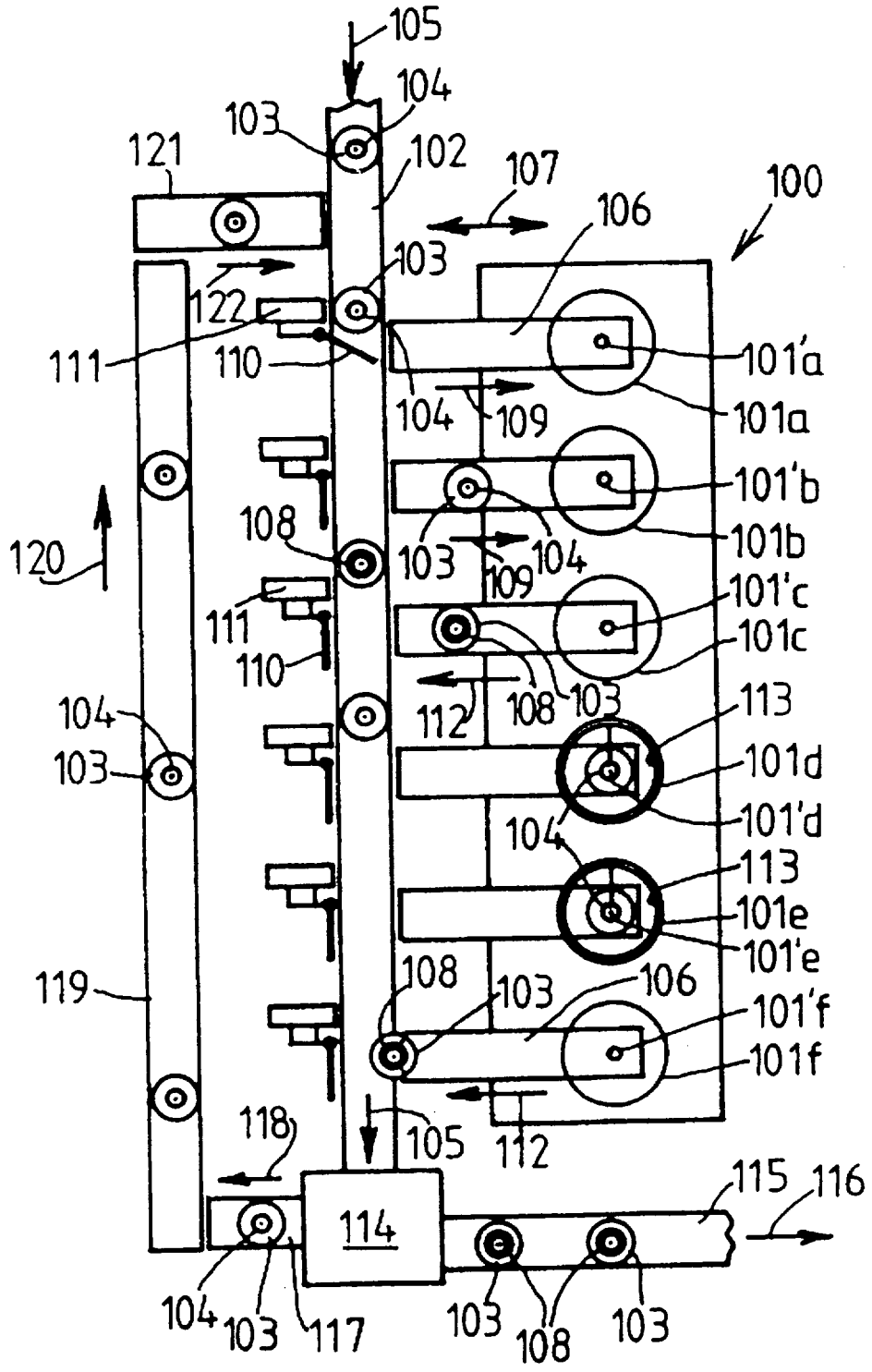
FIG. 3 is a schematic plan view which shows an alternative embodiment of a pot spinning machine wherein empty tubes supported on carriers are supplied to the individual spinning stations and spinning cops are removed from the stations via reversible belts.

FIG. 3 shows a further exemplary embodiment of the invention wherein the conveyor belt does not extend directly underneath the spinning pots but along the front of the spinning machine. Specifically, a conveyor belt 102 extends along the front side of the pot spinning machine 100 which is comprised of a plurality of spinning stations 101*a* to 101*f* symbolized by the spinning pots and the yarn guides 101'*a* to 101'*f*. Carriers 103 are transported along this conveyor belt 102 in the direction 105 carrying on their arbors empty tubes 104 from a supply station (not shown). One respective conveyor belt 106, which can be driven reversibly in opposite directions as indicated by the arrow 107, extends between each spinning station 101*a* to 101*f* and the conveyor belt 102.

Each conveyor belt 106 is used to transport carriers 103 with empty tubes 104 as needed to the spinning stations 101*a* to 101*f*, and to transport spinning cops 108 from the spinning stations to the conveyor belt 102. By way of example, a completed spinning cop has been moved away from the spinning station 101*a* and a carrier 103 with an empty tube 104 is traveling to the spinning station so that the spinning cake in the spinning pot can be respooled on the empty tube. So that a carrier with an empty tube can be provided to the spinning station 101*a* via the conveyor belt 106, this conveyor belt 106 moves in the transport direction 109 in the direction toward the spinning station.

Controllable deflectors 110 are located opposite each spinning station at each junction of the conveyor belt 102 with the conveyor belts 106. When full spinning cops 108 are being moved on the conveyor belt 106 away from the spinning stations, they are automatically taken by the conveyor belt 102 and transported away in the direction 105. However, the supply of empty tubes to the spinning stations must be initiated by an intervention of normal travel of carriers on the conveyor belt. For this reason, a deflector 110 is provided at each junction of a conveyor belt 106 extending between the conveyor belt 102 and the spinning stations 101*a* to 101*f*. A sensor 111 is installed along the conveyor belt 102 upstream in its transport direction 105 in advance of each junction with a conveyor belt 106. Full spinning cops 108 can be distinguished from empty tubes 104 with the aid of these sensors. If a carrier 103 with an empty tube 104 approaches a spinning station which is in need of an empty tube, for example, the spinning station 101*a*, the empty tube 104 is detected by the sensor 111 and the associated deflector 110 at the spinning station 101*a* is extended across the conveyor belt 102. Since the conveyor belt 102 continues to move, the carrier 103 with the empty tube 104 will contact the deflector 110 and is diverted onto the adjacent conveyor belt 106 moving in the transport direction 109 toward the associated spinning station 101*a*. The deflection of a carrier 103 with an empty tube 104 is shown to have already taken place at the spinning station 101*b*. The associated deflector 110 has already been retracted from the conveyor belt 102 in order not to hamper the movement of following empty tubes and spinning cops.

Once the spinning cake has been respooled on an empty tube at one of the spinning stations, such as has occurred at the spinning station 101*c*, for example, the spinning cop 108 is moved on the conveyor belt 106 in the transport direction 112 toward the conveyor belt 102. A yarn is shown in the process of being spun at the spinning stations 101*d* and 101*e* wherein each yarn exits from a respective yarn guide 101'*d* and 101'*e* to form a spinning cake in the respective spinning pots. Empty tubes 104 are already positioned beneath the respective spinning pots in readiness for respooling at the spinning stations 101*d* and 101*e*.

At the spinning station 101*f*, a spinning cop 108 has been discharged from the spinning station 101*f* and has been brought via the associated conveyor belt 106 in the transport direction 112 to the conveyor belt 102 whereat continuing transportation of the carrier 103 supporting the spinning cop 108 is just being taken over by the conveyor belt 102.

Carriers 103 with spinning cops 108 as well as carriers 103 with empty tubes 104 are transported together on the conveyor belt 102 in the transport direction 105 to a sorting station 114 at which the carriers 103 with the spinning cops 108 are separated from the carriers 103 with empty tubes 104 which were not diverted to a spinning station. For example, carriers 103 with full spinning cops 108 are delivered to a conveyor belt 115 for movement in the transport direction 116 to a spooling frame (not shown). Carriers 103 with empty tubes which were not diverted to a spinning station are delivered from the sorting station 114 onto a conveyor belt 117 which travels in the transport direction 118. In this manner, the unneeded empty tubes 104 on the carriers 103 can be returned to the conveyor belt 102 via conveyor belts 119,121, which travel in the transport directions 120,122, respectively.

Figure 4:
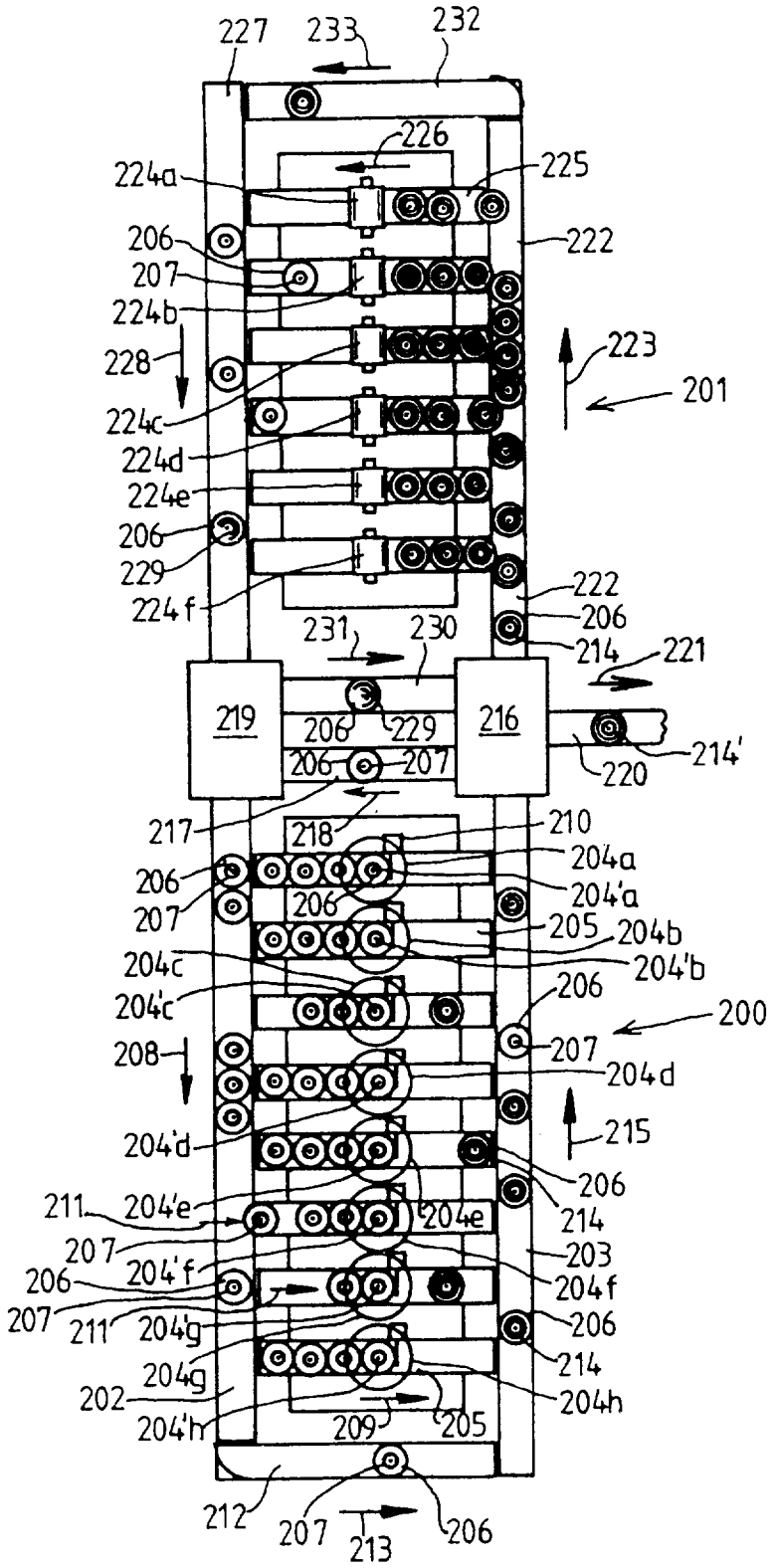
FIG. 4 is a schematic plan view that shows a combined pot spinning machine and winding frame, wherein a supply belt for carriers with empty tubes extends along the front of the spinning machine and a conveyor belt for removing the carriers with wound spinning cops extends along the back of the machine, and wherein the belts are connected with each other underneath each spinning station via a belt for supplying empty tubes and removing spinning cops.

FIG. 4 shows a further exemplary embodiment of a transport system in accordance with the invention. A pot spinning machine 200, whose number of spinning stations may be greater or less than shown in the exemplary embodiment, is connected with a yarn winding frame 201 via conveying means.

In contrast with the previous embodiment of FIG. 3, a conveyor belt 202 extends along the front side of the pot spinning machine 200 and a conveyor belt 203 extends along the back side of the spinning machine. At each spinning station 204*a* to 204*h*, which are symbolized by the spinning pots and the yarn guides 204'*a* to 204'*h*, a conveyor belt 205 travels under the spinning stations and connects the two conveyor belts 202 and 204.

Carriers 206 supporting vertically placed empty tubes 207 on their arbors are transported on the conveyor belt 202 along the spinning stations 204*a* to 204*h* in the direction of the arrow 208. The conveyor belt 202 is narrower than the diameter of the carriers 206. The conveyor belts 205 extend into sufficiently close proximity to conveyor belt 202 that, because of the greater diameter of the carriers 206 than the width of the conveyor belt 202, a portion of the carriers 206 overlap the conveyor belts 205 enabling each belt 205 to pull carriers 206 from the conveyor belt 202 onto the conveyor belt 205 when required. The conveyor belts 205 continuously move in the direction of the arrow 209 in the direction toward the conveyor belt 203. Controllable restraining devices 210 are provided underneath the spinning stations 204*a* to 204*h* to respectively restrain each successive carrier with an empty tube long enough until a spinning cake at the respective station has been respooled on the empty tube. The conveyor belts 205 continuously run during spinning and respooling.

The lengthwise extent of a conveyor belt 205 from the conveyor belt 202 to the associated spinning station is selected such that the belt 205 can take up a predetermined number of carriers 206. At those spinning stations where the associated conveyor belt 205 is not completely occupied by carriers 206, such as at the spinning stations 204*f* and 204*g*, passing carriers 206 with empty tubes 207 being transported by the conveyor belt 202 are diverted by the respective conveyor belts 205 to the respective spinning stations as indicated by the arrows 211. At those spinning stations where a conveyor belt 205 is completely occupied by carriers 206 in front of the spinning station, for example at the spinning station 204*a* and 204*d*, the carriers automatically travel past the spinning station. Carriers 206 with empty tubes 207, which have not been removed from the conveyor belt 202 at any spinning station, are delivered onto a conveyor belt 212 at the end of the spinning machine which conveys the carriers in the transport direction 213 to the conveyor belt 203 at the back of the machine.

Full spinning cops 214 on the carriers 206 are transported away from the spinning machine on this conveyor belt 203.

Once a spinning cake from a spinning pot has been respooled on an empty tube at any of the spinning stations, the associated restraining device 210 releases the carrier 206 with the spinning cop 214 to enable it to be transported to the conveyor belt 203 by means of the conveyor belt 205. Spinning cops 214 are shown as just being conveyed onto the conveyor belt 203 at the spinning stations 204*c*, 204*e*, and 204*g*. The conveyor belt 203 transports the spinning cops 214, as well as the carriers with the empty tubes 207 which have been delivered via the conveyor belt 212, to a sorting and preparation station 216. In the sorting and preparation station, the carriers 206 with empty tubes 207 are directed to a conveyor belt 217 and transported in a transport direction 218 to a further sorting station 219 which operates to transfer these carriers back to the conveyor belt 202.

The full spinning cops 216 are also prepared for respooling on the winding frame 201 in the sorting and preparation station 216. Spinning cops 216 which are not properly prepared automatically within the station 216 are moved into a stand-by position 220, as indicated by the arrow 221, in order to be manually prepared, if required. The prepared spinning cops 214 on their carriers 206 are transferred from the station 216 to a conveyor belt 222 which transports the spinning cops in the direction of the arrow 223 along the winding stations 224*a* to 224*f* which have been symbolized by cheeses under formation. Comparable with the arrangement of the pot spinning machine 200, a respective conveyor belt 225 extends underneath each winding station to convey the carriers 206 with spinning cops 214 in the direction 226 from the conveyor belt 222 to the winding stations and then to a terminal point at a conveyor belt 227 extending along the back of the winding frame.

The spinning cops 214 are unwound and respooled onto cheeses at the winding stations 224*a* to 224*f*. The resulting empty tubes 207 on the carriers 206 are transported by the conveyor belts 225 to the conveyor belt 227 which, in turn, conveys them in the transport direction 228 to the sorting station 219. Any carriers 206 with tubes 229 which were incompletely unwound are separated from carriers 206 with empty tubes and are transferred to a conveyor belt 230 which transports the tubes with usable remaining yarn in the indicated direction 231 to the sorting and preparation station 216 wherein the leading yarn end is made ready for a continuation of winding. If this yarn end preparation is not successful, the spinning cop is removed and placed into the standby position 220.

The transport system presented in FIG. 4 achieves a closed carrier circuit between a pot spinning machine and a winding frame. The carriers and the tubes and cops supported thereon can be employed in the spinning machine as well as in the winding frame without human intervention and without transferring the empty tubes or the spinning cops from one transport system to another. Spinning cops which were not taken up by any of the winding stations are directed at the end of the conveyor belt 222 onto a conveyor belt 232 moving in the transport direction 233 and disposed parallel to the conveyor belts 225 under the spooling stations. The belt 232 guides the carriers with full spinning cops onto the belt 227 which transports them to the sorting station 219 and therefrom to the sorting and preparation station 216, where the carriers and their cops are again placed on the belt 222 for delivery to the winding stations.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A pot spinning machine, comprising:

a plurality of spinning stations each comprising a rotatable spinning pot disposed in a fixed location, means for rotating the spinning pot, yarn guide means for traversing movement within the spinning pot to deposit a quantity of yarn annularly within the spinning pot, the yarn guide means including means for holding an empty tube within the annularly deposited quantity of yarn within the spinning pot for yarn respooling from the spinning pot, means for respooling the annularly deposited quantity of yarn from the spinning pot onto the empty tube of the holding means to form a full yarn cop, and means for moving the yarn guide means between a raised spinning position within the spinning pot and a lowered tube exchange position below the spinning pot, and a system for transporting empty tubes to and full cops from the spinning stations comprising conveyor means extending beneath the spinning stations, the conveyor means including a plurality of upstanding arbors for supporting empty yarn tubes and full yarn cops, the conveyor means being disposed to transport a first empty arbor and a second arbor supporting an empty yarn tube in sequence through a position directly aligned beneath the lowered tube exchange position of the yarn guide means of a spinning station, wherein the yarn guide means of a spinning station includes means for placement of the full yarn cop in upright disposition onto the first empty arbor after completion of a respooling operation and means for grasping the empty yarn tube from the second arbor to begin a new respooling operation.

2. A pot spinning machine in accordance with claim 1, wherein the conveyor means comprises a conveyor belt equipped with fixed arbors extending successively underneath the plural spinning stations along the spinning machine for transporting empty tubes to the spinning stations and full yarn cops away from the spinning stations and means for moving the belt from a receiving position disposing an empty arbor beneath the yarn guide of a spinning station for receiving a full yarn cop into a delivery position disposing an arbor with an empty tube beneath the yarn guide of a spinning station for replacing the full yarn cop previously received.

3. A pot spinning machine in accordance with claim 1, wherein the conveyor means comprises a conveyor belt extending successively underneath the plural spinning stations along the spinning machine and independent carriers equipped with arbors supported on the conveyor belt for transportation to and from the spinning stations, including carriers with empty arbors for receiving full yarn cops from the spinning stations and carriers with empty tubes on their arbors for placement on the yarn guides of the spinning stations following discharge of full spinning cops.

4. A pot spinning machine in accordance with claim 1, wherein the conveyor means includes a supply conveyor belt disposed along the spinning machine at one side of the spinning stations, independent carriers with arbors supported on the supply belt for transportation to and from the spinning stations, including carriers with empty tubes placed on their arbors, and a secondary conveyor belt associated with each spinning station to extend beneath its yarn guide for delivering carriers with empty tubes from the supply conveyor belt to the spinning stations.

5. A pot spinning machine in accordance with claim 4, wherein the conveyor means comprises a discharge conveyor belt disposed along the spinning machine at the opposite side of the spinning stations for removing the carriers with full yarn cops from the secondary belts.

6. A pot spinning machine in accordance with claim 5, wherein the discharge conveyor belt extends to a second supply conveyor belt associated with a winding machine for delivering carriers with full yarn cops to the second supply conveyor belt, the second supply conveyor belt extends along a plurality of winding stations of the winding machine for transporting the carriers with the full yarn cops to the winding stations, and a second discharge conveyor belt extends from the winding machine to the spinning machine for returning thereto carriers with empty tubes for re-supply to the spinning stations.

* * * * *